US008251477B2

(12) United States Patent
Borrell et al.

(10) Patent No.: US 8,251,477 B2
(45) Date of Patent: Aug. 28, 2012

(54) MULTIPASS PRINTING METHOD

(75) Inventors: M. Isabel Borrell, Barcelona (ES); Angel Martinez, Barcelona (ES); Sergio Puigardeu, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1011 days.

(21) Appl. No.: 11/790,986

(22) Filed: Apr. 30, 2007

(65) Prior Publication Data

US 2008/0266343 A1 Oct. 30, 2008

(51) Int. Cl.
*B41J 2/205* (2006.01)

(52) U.S. Cl. ..... 347/15

(58) Field of Classification Search ..... None
See application file for complete search history.

(56) References Cited

U.S. PATENT DOCUMENTS 6,238,112 B1 5/2001 Girones et al.
6,283,572 B1 9/2001 Kumar et al.
6,293,646 B1 9/2001 Beachnau-Hood et al.
6,310,640 B1 10/2001 Askeland
6,345,878 B1 * 2/2002 Kanaya ..... 347/23
6,481,823 B1 11/2002 Bauer et al.
6,554,392 B2 4/2003 Vega et al.
6,575,545 B2 6/2003 Bruch et al.
7,036,897 B2 5/2006 Gaston et al.
7,036,900 B2 * 5/2006 Vanhooydonck et al. ..... 347/12
2002/0011693 A1 * 1/2002 Leyden et al. ..... 264/308
2003/0038856 A1 * 2/2003 Vega et al. ..... 347/23
2004/0135844 A1 * 7/2004 Yang et al. ..... 347/40
2006/0214959 A1 9/2006 Yamanobe
2006/0262155 A1 11/2006 Kuwahara et al.
2007/0070117 A1 3/2007 Park

* cited by examiner

*Primary Examiner* — Matthew Luu
*Assistant Examiner* — Alejandro Valencia

(57) ABSTRACT

A multipass printing method includes determining at the end of a printing pass if at least some dot depositing elements of at least one printhead require a servicing operation. In case the determination is positive, the method includes printing at least one incomplete printing pass in which at least the dot depositing elements of the at least one printhead that require a servicing operation are not operated to print. At the end of the incomplete printing pass, the method includes servicing at least the dot depositing elements of the at least one printhead and printing at least one compensating printing pass, which adds to the information to be printed in the compensating printing pass at least part of the information that failed to be printed by the dot depositing elements of the at least one printhead in the at least one incomplete printing pass.

17 Claims, 6 Drawing Sheets

FIG. 2
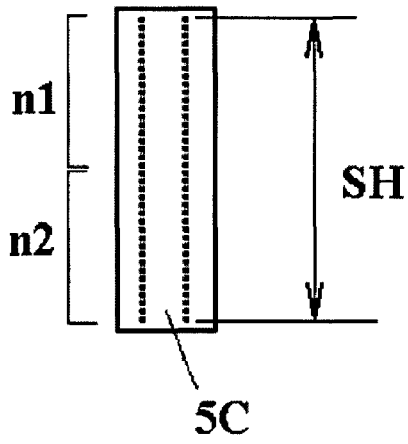
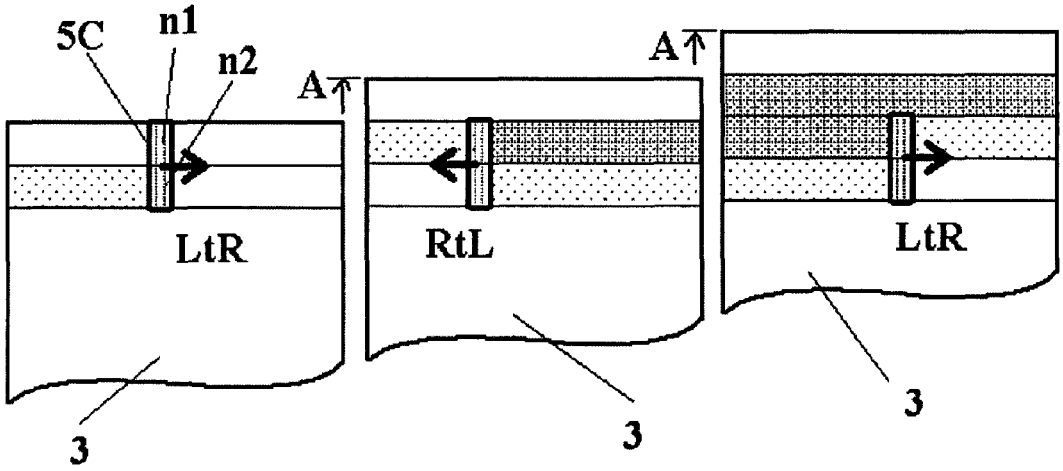
FIG. 3

MULTIPASS PRINTING METHOD

FIELD OF THE INVENTION

The present invention relates to a multipass printing method.

BACKGROUND TO THE INVENTION

Inkjet printers use at least one printhead provided with a plurality of nozzles, from which ink droplets are fired or ejected onto the media; the printer controls the firing of ink from the nozzles such as to create on the media a pattern of dots corresponding to the desired image, plot, drawing, etc.

Color printers are typically provided with several printheads, for example one for each of the primary colors cyan, yellow, magenta (CYM) and black (K). The printheads may be mounted on a carriage that reciprocates in successive passes above the media along a scan direction, with the nozzles firing droplets of ink as the printhead moves across the media; after each printing pass of the printheads, the media is advanced in a media advance direction, at right angles to the scan direction, such that a plot is formed on the media in successive passes of the printheads.

The nozzles are typically arranged in one or more linear arrays, extending in the media advance direction; the length of the nozzle arrays is usually referred to as the swath height, and it corresponds to the maximum pattern of ink that can be laid down on the media in a single pass.

Such a printer can operate according to several different print modes: in a single-pass print mode, after each printing pass the media is advanced a distance equal to the printhead swath height, such that each pass forms on the media a complete strip of the image; on the contrary, in a multi-pass print mode the media only advances a fraction of the swath height after each printing pass of the printheads, for example ½, ¼ or ⅛ of the swath height, and each strip of the image to be printed is formed in successive and partially overlapping passes. Multi-pass print modes are typically used for obtaining higher quality plots.

Printing can be unidirectional, i.e. the printheads only print when travelling in one direction along the scan axis, and then they travel in a return pass without printing, or it can be bidirectional, i.e. the printheads print when travelling in a "forward pass" and also when travelling in a "return pass", the media being advanced after each pass.

A printer can have a service station at least at one end of the path of travel of the printheads along the scan axis, in order to maintain the proper functioning conditions of the printheads, for example by performing a number of servicing operations such as wiping and spitting ink, or by capping the nozzles when not in use.

Maintenance operations may be carried out between print jobs; however, it is also known to perform some servicing operations while printing, i.e. during a print job. This may be done for example to avoid or reduce the drying of ink which is in position to be fired from the nozzles, due to the exposure to air during a print job, i.e. when the nozzles are not capped; this effect is known as "decap", and it may cause a loss in the quality of the printed plot. "Slewing decap" is related to the current of air created by the printheads as they travel or slew along the scan axis, which increases the negative effects on the drying of the ink in the nozzles. Pigmented inks are particularly sensitive to idle times.

Typical defects of the first drops ejected after the nozzles have been idle a period of time are related to higher colorant concentration, poor drop shape, lower drop weight and/or velocity, drop placement errors, etc. These defects can cause image quality problems such as color discontinuities or a high level of grain.

Thus, to avoid or reduce the effects of decap and slewing decap, a printhead can be serviced during printing, for example by causing the printhead to travel to the service station between two printing passes and spitting ink through the nozzles, if the nozzles of the printhead exceed a predetermined time without firing ink drops on the media (for example as a result of the features of the plot being printed). Spit of a printhead during printing has been referred to as "flying spit" or "spit on the fly".

Commonly assigned U.S. Pat. No. 6,554,392 discloses a printing apparatus with a main service station and an auxiliary service station, one at each end of the scan axis, and a printing method that comprises spitting a printhead either in the main or in the auxiliary service stations before printing each pass, if the time elapsed since the printhead was refreshed, either by printing or by a flying spit, exceeds a threshold value.

This improves the printing quality by avoiding or reducing the effect of decap; however, the spitting operation in the auxiliary service station entails the need for the carriage to overtravel a distance from the end of the plot to this service station, which is located at the end of the scan axis, and this may reduce the throughput of the printing operation.

Overtravel of the carriage to the auxiliary service station is significantly greater than overtravel to the main service station, since the media is always loaded in the printer adjacent the side where the main service station is arranged, and in many cases the media being printed is not as wide as the maximum width the printer can handle, so the auxiliary service station is remote from the edge of the media. The loss of throughput is thus especially severe when the media and the plot being printed are substantially narrower that the maximum media width of the printer.

SUMMARY OF THE INVENTION

The present invention seeks to provide a printing method that achieves a good balance between throughput and printing quality.

According to a first aspect, the present invention relates to a multipass printing method, comprising:

determining at the end of a printing pass if at least some dot depositing elements of at least one printhead require a servicing operation;

in case the determination is positive, printing at least one incomplete printing pass in which at least the dot depositing elements of said at least one printhead that require a servicing operation are not operated to print;

at the end of said incomplete printing pass, servicing at least said dot depositing elements of said at least one printhead; and printing at least one compensating printing pass adding to the information to be printed in said compensating printing pass at least part of the information that failed to be printed by said dot depositing elements of said at least one printhead in said at least one incomplete printing pass.

BRIEF DESCRIPTION OF THE DRAWINGS

Particular embodiments of the present invention will be described in the following, only by way of non-limiting example, with reference to the appended drawings, in which:

FIG. 2 is a schematic view of the nozzles of a printhead;

FIG. 3 is a diagram showing an example of a printing operation in a two-pass printmode;

DETAILED DESCRIPTION OF THE INVENTION

For assisting understanding of the printing methods according to embodiments of the invention that will be described in the following, in the first place a known printing operation will be described with reference to FIGS. 1 to 3.

Figure 1:
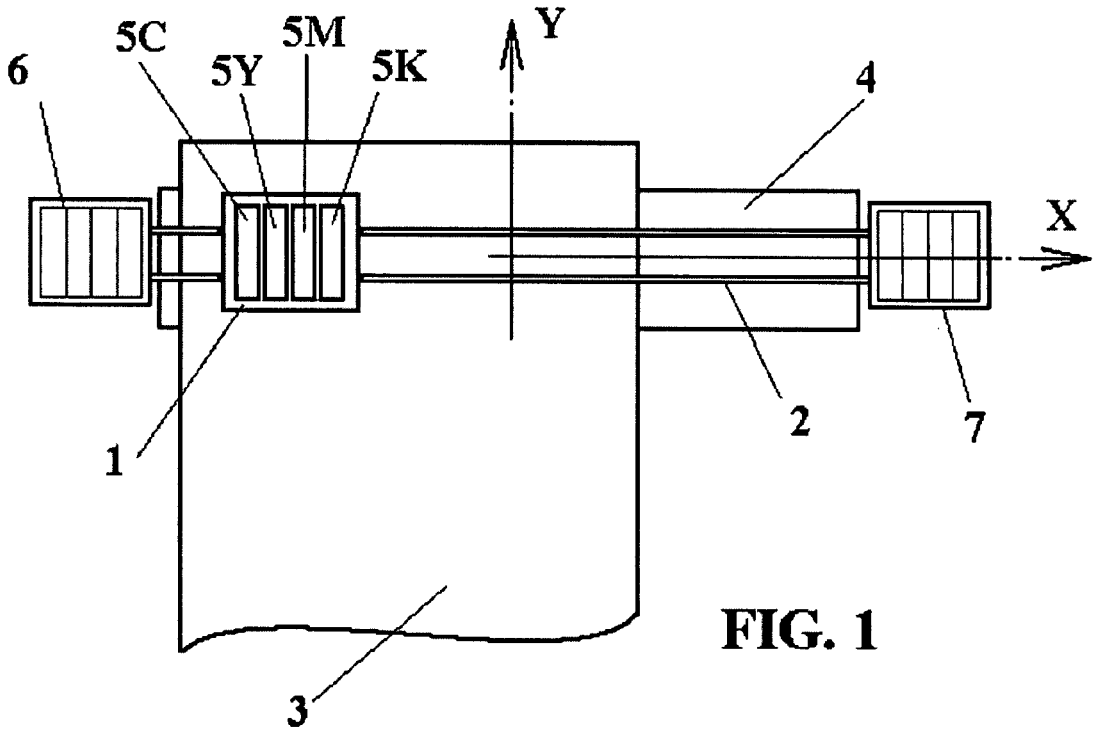
FIG. 1 is a diagram view showing in plan view the relevant parts of a printing apparatus in which the method of the invention may be applied.

In the inkjet printing apparatus of FIG. 1 a carriage 1 can reciprocate along a scan axis 2 in a so-called horizontal or scan direction X, and a print media 3 lies on a print platen 4 under the carriage 1, and can travel in a media advance or vertical direction Y, on said platen. The print media may be paper or any other suitable material, in sheet or web form.

On the carriage 1 are mounted four inkjet printheads 5C, 5Y, 5M and 5K, one for each of the primary ink colors cyan, yellow and magenta, and one for black ink, for firing droplets of ink on the media as the printhead performs a printing pass over the media along the scan axis 2.

In bidirectional printing, the carriage travels from left to right in a printing pass; the media is then advanced a step in direction Y, and then the carriage travels from right to left in another printing pass.

Each of the printheads comprises a large number of nozzles from which ink drops are fired onto the media. FIG. 2 shows schematically the underside of printhead 5C: in one example, it may comprise two parallel columns of nozzles in the Y direction, with one hundred and fifty nozzles in each column at a spacing of one-twelfth millimetre; the resolution is thus of twenty-four nozzles per millimetre. Reference SH indicates the swath height, i.e. the widest strip that the printhead may print in a single pass. For the sake of clarity the figure doesn't show the real proportions, particularly in the number and size of the nozzles.

In each printing pass of the carriage over the media the nozzles of each printhead may fire drops of ink in selected locations on the media, such as to form an image.

In multipass printmodes, the media is advanced only a fraction of the printhead swath height after each printing pass, and only a fraction of the ink dots required to form a strip of the image is laid down in each printing pass, such that areas left unprinted in one pass are filled in during one or more passes. The final image is thus formed in a number of consecutive and partly overlapping passes.

The quality of the printed images in multipass printmodes, such as two-pass or four-pass printmodes, is higher that in a single-pass or draft mode; however the printing speed is lower, and therefore the throughput is also lower. In many printing apparatuses the user is able to choose between different printmodes.

FIG. 3 shows, by way of example, three positions of the printhead in a two-pass, bidirectional printing operation.

In the first drawing of FIG. 3, the nozzles n2 (FIG. 2) of a printhead 5C print on the media 3 a first strip of image, of a height corresponding to half the swath height, as the printhead travels in a first left-to-right pass (LtR) of the printhead.

The media would then be advanced as shown by arrow A, a distance corresponding to half the swath height SH, and the printhead subsequently prints a right-to-left pass (RtL), as shown in the second drawing: in this RtL pass the nozzles n1 print on the same strip of paper that was printed by nozzles n2 in the previous LtR pass, and complete the image on this strip, while the nozzles n2 print a first part of the image to be printed on the next strip of media 3. Once the printhead reaches the left end of the printer, the media is again advanced a distance A.

The first printed strip of media (upper part of the drawing) is now complete, and it has been printed by nozzles n2 in the first LtR pass and by the nozzles n1 in the second RtL pass.

The third drawing of FIG. 3 shows the next LtR pass, in which nozzles n1 complete the second strip of the image, while nozzles n2 print a first part of the image on the third strip of media; this process is repeated until the whole plot is finished.

A print job received by the printer, including for example a printmode selection, is converted to a stream of data corresponding to printer-specific commands, for example commands associated with media movement, printhead movement, nozzle firing, etc.; in particular, a binary pattern known as a printmask, associated to each printhead and each pass, determines which information of the image is effectively printed on the media in each pass, i.e. which of the ink drops necessary to form the image are fired from each nozzle in each printing pass.

Turning back to FIG. 1, a main service station 6 and an auxiliary service station 7 are shown adjacent each one of the ends of the scan axis 2, such as disclosed in U.S. Pat. No. 6,554,392 cited above; reference can be made to this prior application for any details regarding the service stations, the determination of the need for spitting a printhead, the spitting operation, and the like.

It is noted that in the figures the main service station has been shown at the left hand side of the printer, and the auxiliary station at the right hand side; however, the stations could be arranged differently, i.e. the main station at the right and the auxiliary station at the left, depending on the layout of each particular printing apparatus; on the other hand, in method according to embodiments of the invention the printing apparatus could have only one service station, as will be explained later on.

Generally, the main service station of the printing apparatus, or the only service station if the apparatus has a single service station, will be arranged at the side of the printer where the media is referenced and aligned when it is loaded on the printer; this means that generally the media to be printed will have a first lateral edge near the main service station, and a second lateral edge that will be near the auxiliary service station only if the media is as wide as the print platen of the apparatus; on the contrary, if the media is narrower than the print platen, as shown for example in FIG. 1, the lateral edge of the media will be at a distance from the auxiliary service station.

U.S. Pat. No. 6,554,392 teaches that at the end of each pass the time elapsed since the last time the printhead was refreshed is determined, wherein refreshing of the printhead may be due either to a spitting operation or to printing. A printhead is then caused to spit in the main spittoon (main service station) or in the auxiliary spittoon (auxiliary service station), depending on the position of the printhead, prior to starting the next printing pass, if it is determined that the time elapsed since it was refreshed exceeds a threshold value.

Printing methods according to embodiments of the present invention avoid a servicing operation, such as spitting, in the auxiliary service station, and thus the loss of throughput due to the time needed for the printhead to travel to and from the auxiliary service station, without a significant loss in printing quality.

An embodiment of the multipass printing method of the present invention is described in the following with reference in the first place to the flow chart of FIG. 4, assuming a layout of the printing apparatus in which the main service station is at the left hand side of the printer as in FIG. 1.

In the following description geometrical references such as left to right pass and right to left pass will be employed. However, it must be understood that these references are given purely by way of example, and that the actual directions will depend in any case on the layout of the printer, and in particular on the position of the main service station.

Figure 4:
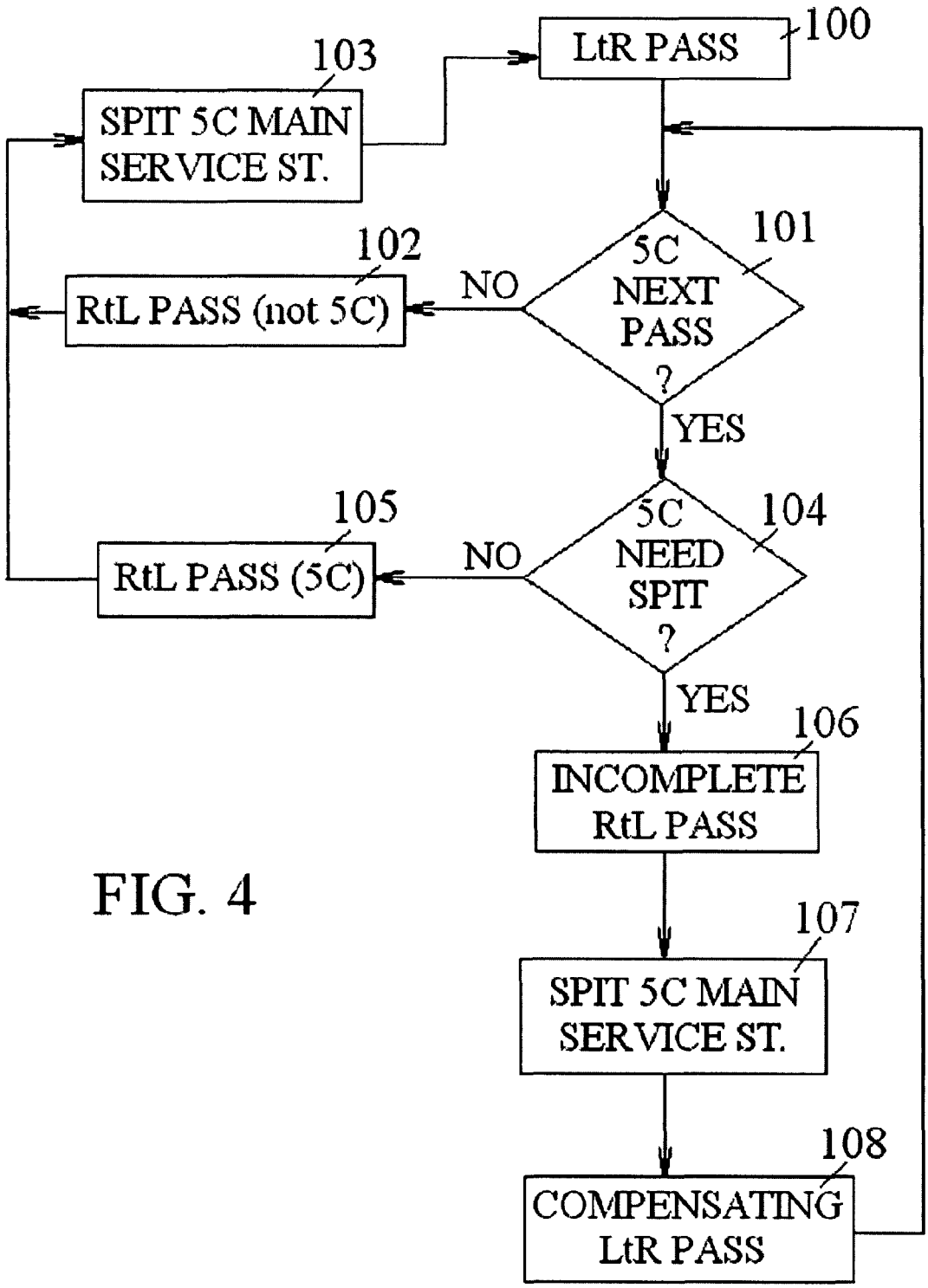
FIG. 4 is a flow chart representing a first embodiment of a printing method according to the present invention.

The flow chart of FIG. 4 is referred by way of example to the printhead 5C corresponding to cyan ink; the method may be similarly applied to all the printheads in the printing apparatus to establish how and when each printhead will be spitted and how and when it will print on the media.

After a left to right (LtR) printing pass in step 100, it is determined in step 101 if printhead 5C has to print in the next right to left (RtL) printing pass.

If it is determined that printhead 5C is not going to print, then in step 102 a RtL printing pass is performed (without printing with 5C), and the printhead may then be spitted in the main spittoon in step 103. This spitting operation after each RtL pass may be either predetermined, or decided upon at each individual pass. Then the following LtR pass is printed in step 100, printing or not with printhead 5C depending on the scheduled printmasks.

If in step 101 it is determined that printhead 5C is scheduled to be used in the next RtL pass, then in step 104 it is determined if printhead 5C needs to be spit.

If the determination is negative, then the next RtL printing pass is performed in step 105 operating printhead 5C to print as scheduled, i.e. printing cyan information on the media according to the corresponding printmask; after this step, the printhead may be spitted in the main spittoon as before, in step 103, and the next LtR pass is printed in step 100.

However, if the determination in step 104 is positive, i.e. printhead 5C needs to be spit, then an incomplete RtL pass is performed in step 106. By an incomplete printing pass it is meant a pass in which the scheduled printmask for printhead 5C is ignored, the printhead is not operated to print information on the media, and therefore at last part of the information (in this case cyan information or cyan ink dots) fails to be printed on the media in this pass.

At the end of the incomplete RtL pass of step 106, the printhead is spit in the main spittoon, in step 107.

After this, a LtR compensating pass is printed in step 108. In this printing pass, printhead 5C is operated to print the cyan information that was scheduled for this print pass, and also the cyan information that was omitted or failed to be printed in the RtL pass in step 106.

After the LtR compensating pass the process continues from step 101.

Steps of a particular example of a printing operation carried out following the method of FIG. 4 will be illustrated in the following with reference to the diagrams of FIGS. 5*a* to 5*h*. In these diagrams two printheads 5M and 5C are considered, with the above method being applied for the sake of clarity only to printhead 5C.

In the following description it will be understood that the media is advanced after each pass, as explained in relation to FIG. 3.

Figure 5A:
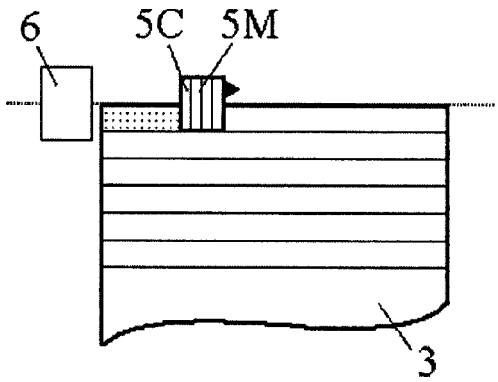
FIGS. 5*a* to 5*h* illustrate steps of an example of the printing method of FIG. 4 as performed on a printing apparatus.

FIG. 5*a* shows a first LtR pass (step 100) in which only printhead 5M is scheduled to print, and prints a first strip with nozzles n2.

Figure 5B:
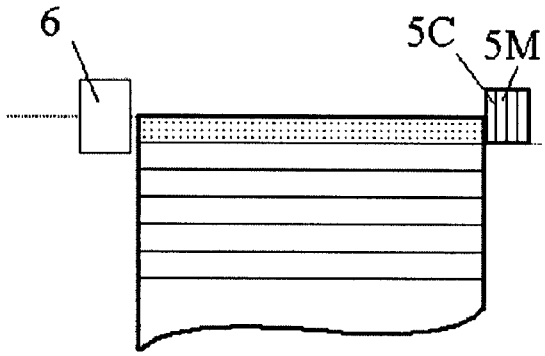
Figure 5C:
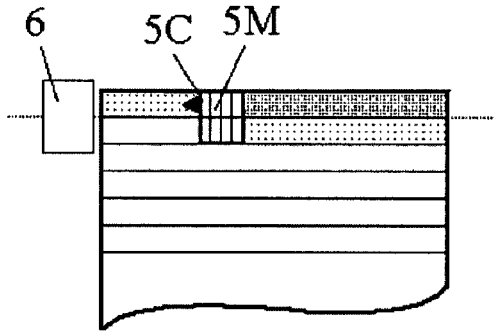
Figure 5D:
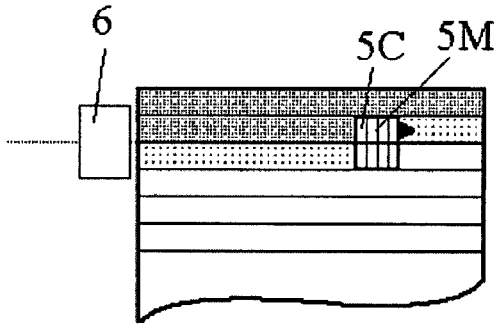

At the end of the LtR pass, in FIG. 5*b*, it is determined that 5C is not scheduled to print in the next pass (step 101, negative determination); FIG. 5*c* shows the subsequent RtL pass (step 102), with only printhead 5M printing. FIG. 5*d* shows a further LtR printing pass, in which again only printhead 5M prints on the media.

At the end of the LtR pass of FIG. 5*d* it is determined that printhead 5C will print in the next pass (step 101, positive determination).

Furthermore, it is determined that printhead 5C needs to be spit, because it has not fired ink in the previous passes and therefore it has exceeded the threshold time since it was last refreshed (step 104, positive determination).

Figure 5E:
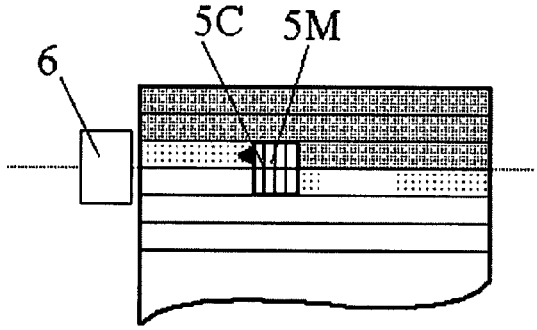

As a consequence, the following RtL pass shown in FIG. 5*e* is an incomplete pass in which the printhead 5M prints as scheduled, but the printhead 5C is not operated to print according to its scheduled printmask. This leaves a blank area on the media, where nozzles n1 of printhead 5C were scheduled to print cyan dots.

Figure 5F:
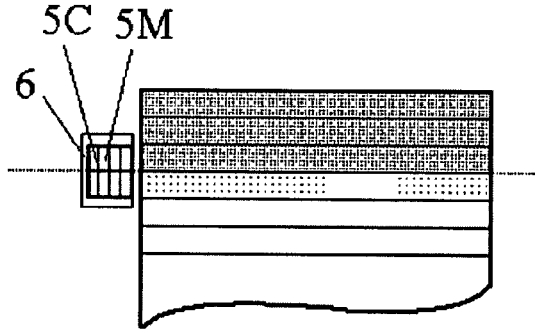

FIG. 5*f* shows the printheads at the end of the incomplete RtL pass of FIG. 5*e*. At this point, before starting the next pass, printhead 5C is spit in the main spittoon (step 107).

Figure 5G:
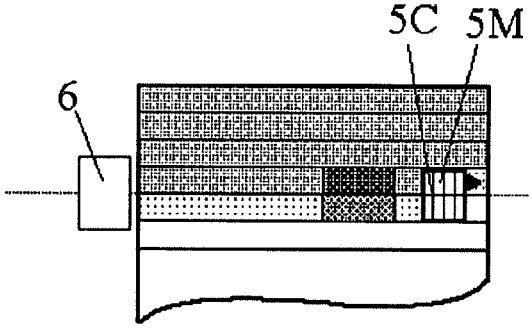

After spitting, a compensating LtR pass is performed (step 108), as shown in FIG. 5*g*: nozzles n1 of printhead 5C print the cyan information (cyan ink dots) that failed to be printed by nozzles n2 in the incomplete pass, as well as the cyan dots that were scheduled for nozzles n1 in this pass, thereby completing in one single pass the cyan image that should have been printed in two passes. Nozzles n2 of printhead 5C print the cyan ink dots scheduled for this pass.

At the end of this LtR compensating pass, it is determined that printhead 5C will print in the next RtL printing pass (step 101, positive determination). However, it is also determined that printhead 5C has not exceeded the threshold time since refreshing, because it has printed during the last printing pass, and therefore does not need spitting (step 10, negative determination).

Figure 5H:
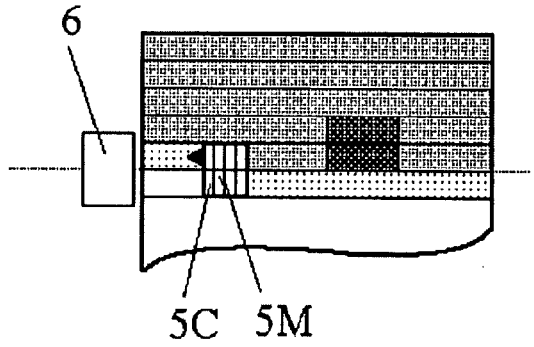

As a consequence, in FIG. 5*h* the next RtL pass is carried out with printhead 5C operated to print as scheduled (step 105).

The same method can be applied to all the nozzles of the printing apparatus, such that the same printing pass can be at the same time an incomplete pass for one of the printheads, and a normal pass for another, or a compensation pass for one of the printheads and a normal pass for another.

It will be understood from the above description that by avoiding over-travel for spitting in the auxiliary spittoon and avoiding printing with a printhead that is in need of servicing, which are the only two possible actions foreseen in the prior art in case of a positive determination in step 104, embodiments of the method save overall printing time and thus improves throughput, without substantially affecting printing quality.

Avoiding over-travel to the auxiliary spittoon also contributes to increase the service life of components, such as the carriage, because it reduces wear.

Furthermore, since in the above embodiment the spitting operations in the auxiliary service station are avoided, this service station is not needed in multipass printing and it can be omitted at least in a printing apparatus with no single-pass mode, with the consequent advantage in footprint and cost reductions.

The operations of FIG. 4 and FIGS. 5*a*-5*h* are only examples of a simple application of an embodiment of the printing method, in a two-pass printmode and applied to an inkjet printer having a printhead for each colour. However, many variants of the method are possible.

In the above embodiments, for example, an incomplete RtL pass is compensated in full by the following LtR compensating pass, but it will be understood that in other multipass printmodes such as four-pass, eight-pass or the like, it is possible to distribute the information that fails to be printed in an incomplete pass over a at least two subsequent LtR and RtL compensating passes.

Furthermore, in the above example a printing apparatus with only one printhead for each primary colour ink has been considered; however, in other printers with a different number or arrangement of printheads the skilled man can consider compensating an incomplete pass of one printhead in a subsequent pass with a different printhead.

Similarly, even though for the sake of simplicity in the embodiment described above a printhead is considered as a unit, the method could also be applied to individual nozzles or groups of nozzles of one printhead, such that for example in step 104 only some of the nozzles were found to need spitting, such that in step 106 only part of the nozzles would be ordered not to print, and only the information or ink dots that failed to be printed by these nozzles would be compensated in step 108.

The compensation in step 108 may be done using known error hiding techniques, such as disclosed in commonly assigned U.S. Pat. No. 6,238,112.

In a simple embodiment, if for a given strip of media the scheduled printmasks foresee printing a RtL printing pass employing the odd nozzles of the nozzle group n2 of the printhead, and a LtR printing pass employing the even nozzles of nozzle group n1, compensation of the RtL printing pass may be effected in the LtR printing pass in step 108 by printing in this compensating pass with both the odd and the even nozzles of group n1 of the printhead.

Figure 6:
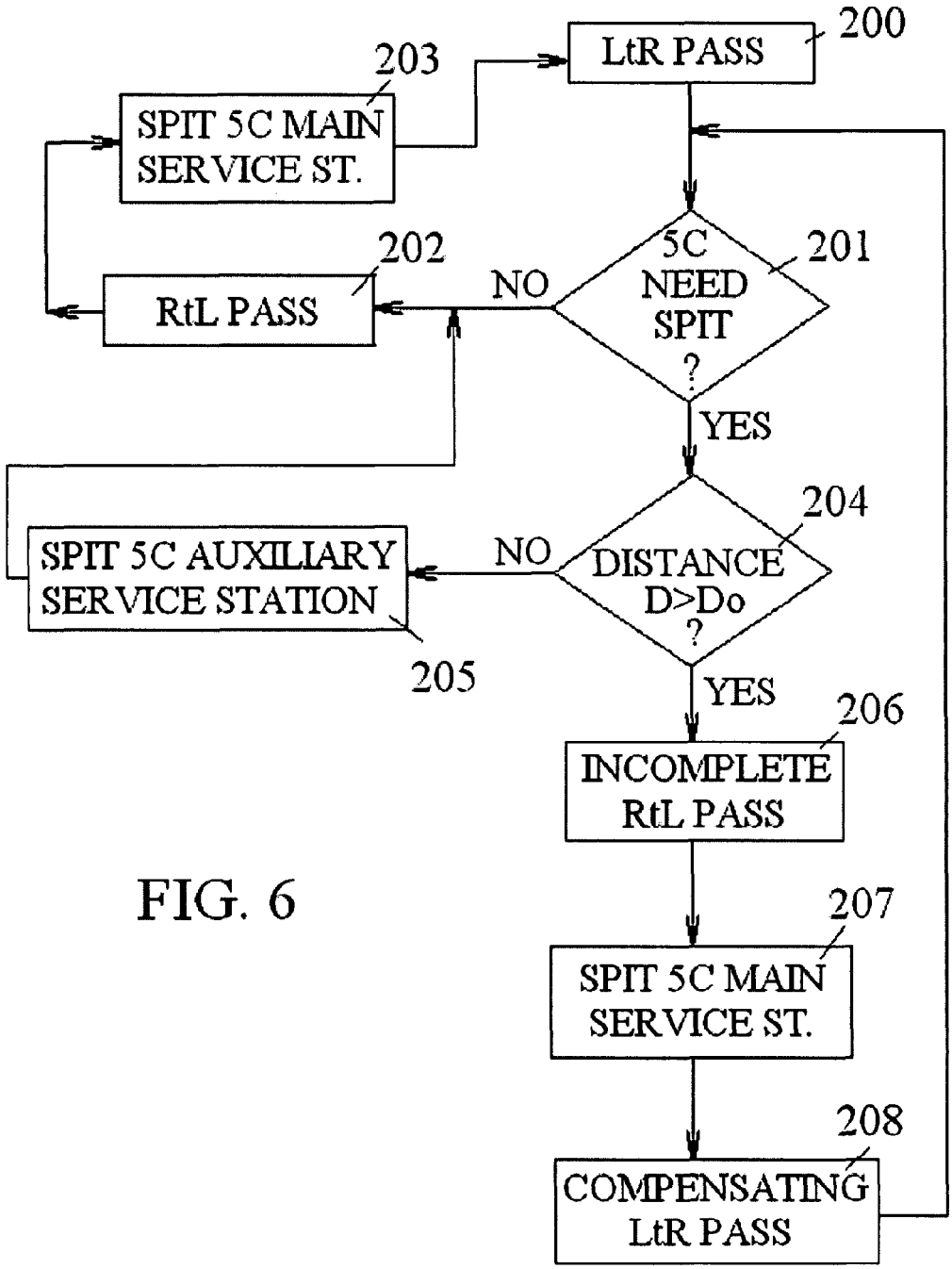
FIG. 6 is a flow chart representing another embodiment of a printing method according to the invention.

FIG. 6 shows another embodiment of a printing method according to the present invention.

In step 200 a LtR printing pass is carried out. At the end of this pass, in step 201 it is determined if printhead 5C needs spitting, possibly after a step (omitted in the workflow) in which, like in the previous embodiment, it is determined that printhead 5C is scheduled to print the next pass.

If the determination in step 201 is negative, then the process proceeds to step 202, wherein a "normal" RtL printing pass is carried out, i.e. a a RtL printing pass in which printhead 5C prints cyan information or ink dots according to the scheduled printmask. After this, the printhead may be spitted in the main spittoon in step 203, before the following LtR printing pass.

If the determination in step 201 is positive, it is determined in step 204 if the distance D between the printhead 5C and the auxiliary service station exceeds a predetermined threshold distance Do.

In case of a negative determination in this step, i.e. if the printhead is not remote from the auxiliary service station, then the process proceeds to step 205, in which the printhead is caused to travel to the auxiliary service station and spits at said auxiliary station. After spitting, a "normal" RtL printing pass is carried out, in step 202.

On the contrary, in case of a positive determination in step 204, i.e. if the distance between the printhead and the auxiliary service station exceeds a predetermined threshold Do, then the process proceeds to steps 206, 207 and 208, which are equivalent to steps 106, 107 and 108 in FIG. 4, i.e. an incomplete RtL pass followed by a spitting operation in the main service station and a LtR compensating pass.

Distance Do can be selected such that the above printing method comprising an incomplete pass and at least one subsequent compensation pass is only carried out when there is a relevant increase of throughput to be gained, i.e. when the over-travel to the auxiliary spittoon is relatively large.

This of course will occur when the plot being printed is significantly narrower than the maximum printer width.

It must be pointed out that the above embodiments have been described in relation to a spitting operation; however, the skilled man will understand that any other servicing operation that may be required on he printheads in order to avoid a loss in the printing quality, such as wiping, can be handled in a similar way.

On the other hand, the same principle of at least one incomplete pass that is compensated in subsequent passes, after a servicing operation has been carried out, can be applied to any other multipass printing technique, different from inkjet printing, in which the printheads may require servicing operations; in particular, it can be applied to any printing method in which an image if formed when colour is deposited on the media in the form of dots of any shape and size by means of dot depositing elements of a printhead.

The invention claimed is:

1. A multipass printing method using a printer having a main service station adjacent a first end of a scan axis and capable of bidirectional printing along the scan axis between the first end and an opposite, second end, the printer omitting an auxiliary service station at the second end, the method comprising:

performing a printing pass along the scan axis in a first direction from the first end toward the second end via an array of dot depositing elements of at least one printhead and completing the printing pass at an intermediate position between the first end and the second end of the scan axis;

determining at the intermediate position, based on at least a time elapsed since the dot depositing elements last ejected ink, if at least some of the respective dot depositing elements require a servicing operation;

in case the determination is positive, printing at least one incomplete printing pass along the scan axis that starts from the intermediate position and moves in a second direction opposite the first direction toward the first end of the scan axis, the at least one incomplete printing pass including suspending operation of the respective service-requiring dot depositing elements while printing from the remaining respective dot depositing elements;

at the end of the incomplete printing pass, servicing the respective suspended dot depositing elements of the at least one printhead via spitting at the main service station and reactivating the suspended dot depositing elements; and printing at least one compensating printing pass in the first direction via at least the reactivated dot depositing elements of the at least one printhead, the printing including simultaneously:

printing, via the reactivated dot depositing elements, information previously omitted in the incomplete printing pass because of the suspended dot depositing elements of the at least one printhead; and printing, via the reactivated dot depositing elements, new information.

2. The method of claim 1, wherein said at least one printhead is an inkjet printhead and the dot depositing elements are ink ejection nozzles.

3. The method of claim 1, wherein printing the at least one compensating printing pass comprises printing the previously omitted information, along with the new information, in one single compensating printing pass.

4. The method of claim 1, wherein printing the at least one compensating printing pass comprises printing the previously omitted information in a manner distributed over at least two consecutive compensating printing passes.

5. The method of claim 1, wherein in case the determination is negative, printing via the at least one printhead in the following printing pass.

6. A method for multipass printing with a printer that comprises an array of printheads that can reciprocate together along a scan axis, a main printhead service station arranged adjacent a first end of the scan axis and an auxiliary service station arranged adjacent a second end of the scan axis opposite the first end, the method comprising:

performing a printing pass relative to a print media, via the array of printheads, along the scan axis in a first direction extending from the first end towards the second end opposite the first end and completing the printing pass at an intermediate position between the first end and the second end of the scan axis;

determining the intermediate position, based on at least a time elapsed since nozzles of each respective printhead last ejected ink, if any of the respective printheads of the array require servicing; and in case of a positive determination, starting from the intermediate position, performing an incomplete printing pass in a second direction opposite the first direction toward the first end, including suspending operation of the service-requiring printheads while printing with the remaining respective printheads of the array;

servicing at least the suspended printheads via spitting in the main service station to reactivate the suspended printheads; and printing at least one compensating printing pass in the first direction, including simultaneously:

printing, via the reactivated serviced printheads, new information and at least part of the information previously omitted from printing in the incomplete printing pass because of respective suspended printheads; and printing, via at least some of the non-serviced printheads, additional new information, wherein the multipass printing includes advancing the print media a fraction of swath height after each respective printing pass to cause the information to be printed in strips of successive, partially overlapping printing passes.

7. The method of claim 6, wherein in case of a negative determination, printing via the at least one printhead in a subsequent printing pass.

8. A method for multipass printing with a printer that comprises at least one printhead that can reciprocate along a scan axis, a main printhead service station arranged adjacent a first end of the scan axis and an auxiliary service station arranged adjacent a second end of the scan axis opposite the first end, the method comprising:

performing a printing pass along the scan axis starting from the first end and extending in a first direction from the first end towards the opposite second end and completing the printing pass at an intermediate position along the scan axis between the respective first and second ends;

determining, at the intermediate position, if at least some of the nozzles of the at least one printhead requires servicing, wherein the determination is based on at least a time elapsed since nozzles of the at least one printhead last ejected ink;

in case of a positive determination, further determining if the distance between the at least one printhead and the auxiliary service station exceeds a predetermined value;

in case the distance exceeds the predetermined value:

returning the at least one printhead in an incomplete printing pass, along the scan axis in a second direction opposite the first direction to the main service station, the incomplete printing pass including suspending operation of the respective service-requiring nozzles while printing with the remaining nozzles of the at least one printhead;

servicing at least the suspended nozzles of the at least one printhead via spitting in the main service station and reactivating the suspended nozzles; and printing at least one compensating printing pass in the first direction, including:

printing, via the reactivated nozzles, new information and at least part of the information omitted from printing in the incomplete printing pass because of the respective suspended nozzles; and printing other new information using the nozzles that did not require service at the completion of the incomplete printing pass; and in case the distance does not exceed the predetermined value:

moving the at least one printhead further in the first direction to the auxiliary service station;

servicing the at least one printhead in the auxiliary service station via spitting; and printing via the at least one printhead in a subsequent printing pass in the second direction.

9. The method of claim 8, wherein printing the at least one compensating printing pass includes printing the omitted information, along with the new information, in one single compensating printing pass.

10. The method of claim 8, wherein printing the at least one compensating printing pass includes printing the omitted information in at least two subsequent compensating printing passes.

11. The method of claim 1, wherein multipass printing comprises:

advancing the print media a fraction of a swath height after each respective printing pass to cause the information to be printed in strips of successive, partially-overlapping printing passes.

12. The method of claim 1, wherein during the at least one compensating printing pass, printing information from at least some of the other dot depositing elements.

13. The method of claim 6, wherein the multipass printing excludes use of the auxiliary service station and the respective printing passes in the first direction are completed adjacent the intermediate position and respective printing passes in the second direction begin adjacent the intermediate position.

14. The method of claim 8, wherein multipass printing comprises:

advancing the print media a fraction of swath height after each respective printing pass to cause the information to be printed in strips of successive, partially overlapping printing passes.

15. The method of claim 1, wherein the intermediate position is substantially closer to the first end than the second end.

16. The method of claim 6, wherein, at the intermediate position, the array of printheads is substantially closer to the first end than the second end.

17. The method of claim 8, wherein the intermediate position is substantially closer to the first end than the second end.

* * * * *

UNITED STATES PATENT AND TRADEMARK OFFICE

CERTIFICATE OF CORRECTION

PATENT NO. : 8,251,477 B2
APPLICATION NO. : 11/790986
DATED : August 28, 2012
INVENTOR(S) : M. Isabel Borrell et al.

It is certified that error appears in the above-identified patent and that said Letters Patent is hereby corrected as shown below:

In column 9, line 18, in Claim 6, delete "the" and insert -- at the --, therefor.

Signed and Sealed this
Twelfth Day of February, 2013

Teresa Stanek Rea
*Acting Director of the United States Patent and Trademark Office*